United States Patent [19]

Champion et al.

[11] 4,326,796

[45] Apr. 27, 1982

[54] APPARATUS AND METHOD FOR MEASURING AND MAINTAINING COPY QUALITY IN AN ELECTROPHOTOGRAPHIC COPIER

[75] Inventors: James R. Champion, Longmont; Larry M. Ernst; Leland W. Ford, both of Boulder; Ronald G. Velarde, Longmont, all of Colo.

[73] Assignee: International Business Machines Corporation, Armonk, N.Y.

[21] Appl. No.: 103,143

[22] Filed: Dec. 13, 1979

[51] Int. Cl.[3] ..... G03G 15/02

[52] U.S. Cl. ..... 355/14 CH; 355/14 R; 355/3 CH

[58] Field of Search ..... 355/14 CH, 14 R, 3 CH

[56] References Cited

U.S. PATENT DOCUMENTS

| | | | |
|---|---|---|---|
| 2,890,343 | 6/1959 | Bolton | 355/14 CH X |
| 3,321,307 | 5/1967 | Urbach | 430/1 |
| 3,782,818 | 1/1974 | Smith | 355/10 |
| 3,787,706 | 1/1974 | DeGeest | 355/3 CH X |
| 3,788,739 | 1/1974 | Coriale | 355/17 |
| 3,835,380 | 9/1974 | Webb | 324/72 |
| 3,891,316 | 6/1975 | Whited | 355/14 |
| 3,892,481 | 7/1975 | Schaefer et al. | 355/10 |
| 3,941,472 | 3/1976 | Nagahara et al. | 355/16 |
| 3,951,541 | 4/1976 | Kuehnle | 355/14 CH X |
| 3,982,830 | 9/1976 | Daniels et al. | 355/3 |
| 4,028,596 | 6/1977 | Weber | 355/14 CH X |
| 4,105,321 | 8/1978 | Urso | 355/3 CH |
| 4,142,791 | 3/1979 | Nishikawa et al. | 355/3 CH X |
| 4,166,690 | 9/1979 | Bacon et al. | 355/3 CH |
| 4,178,095 | 12/1979 | Champion et al. | 355/14 R |
| 4,179,213 | 12/1979 | Queener | 355/14 R |
| 4,183,657 | 1/1980 | Ernst et al. | 355/14 R |
| 4,204,725 | 5/1980 | DiStepheno et al. | 355/14 CH X |
| 4,234,249 | 11/1980 | Weikel, Jr. et al. | 355/14 CH X |

OTHER PUBLICATIONS

Ser. No. 141,860, Filed 04/21/80, "Test Cycle Quality Control System for an Electrophotographic Machine," C. C. Wilson, Assigned to IBM Corporation, a continuation of Ser. No. 894,956, Filed 04/10/78, same Title, Inventor and Assignee, Abandoned 04/21/80.

*Primary Examiner*—Gene Z. Rubinson
*Assistant Examiner*—Richard M. Moose
*Attorney, Agent, or Firm*—Gunter A. Hauptman

[57] ABSTRACT

Factors affecting copy quality are continuously adjusted during copying in accordance with the actual charge on the photoconductor relative to a fixed reference potential. The photoconductor, carried on a moving, partially exposed, constant potential conductive support, is sensed by a probe. The probe supplies a signal as a function of the potential on portions of the photoconductor and the conductive support passing by the probe. A circuit converts the probe signals into digitized values representing the current photoconductor potential relative to the support. The digitized values adjust copier parameters to compensate for deviations of photoconductor potential from predetermined desired values.

5 Claims, 8 Drawing Figures

MEASUREMENT AND COMPARISON CIRCUIT 7

CONTROL LOGIC 11

CONTROL LOGIC 11

SUBROUTINE

APPARATUS AND METHOD FOR MEASURING AND MAINTAINING COPY QUALITY IN AN ELECTROPHOTOGRAPHIC COPIER

BACKGROUND OF THE INVENTION

1. Field of the Invention

The invention relates to electrophotographic devices and, more particularly, to adjusting the charge on a photoconductive surface to a predetermined level chosen for optimum copy quality.

2. Description of the Prior Art

In electrophotographic devices, such as a xerographic copier, a photoconductive surface is charged in a pattern representing an optical image to be copied. A developing material is applied to the surface, in accordance with the charge, and then transferred to a copy document. A variety of illumination, developer application and charge transfer operations are involved. The final copy quality is determined by the accuracy of adjustment of these operations prior to copy production. Typically, optimum adjustment limits are specified by the manufacturer for a particular copier model at the time of manufacture. However, variations between particular copiers, the effects of aging, special environmental conditions, etc., all affect the actual adjustments required on an individual copier to initially obtain, and continuously maintain, optimum copy quality.

The charge on the photoconductor surface, in response to a reference stimulus, is a key indicator of the degree of proper adjustment of a copier. Once this reference charge is known for an individual copier, that copier can be readily adjusted for optimum performance by monitoring the charge until a predetermined reference value is achieved. Subsequent copies will then have optimum quality for a period of time until readjustment is again required.

Since the amount of developer retained on the photoconductor is determined by the charge thereon, optical reflectance has been used as an indicator of surface charge in the prior art. The surface charge has also been measured directly with electrometers. In U.S. Pat. No. 3,788,739, an electrometer probe, placed in proximity to the photoconductor surface, controls charge, exposure, transfer and development elements to compensate for variations between the actual charge values and a fixed reference charge value. Electrometers are, however, expensive devices requiring complex associated circuitry and sensitive physical adjustments for proper operation. Electrometer probes become ineffective for accurate measurement when, as inevitably occurs, they become coated with developer material. In addition, the electrometer output must typically be modulated before it can be used for either measurement or control. The potential, typically on the order of several hundred volts, is very hard to measure without drawing a current so large that the potential is significantly lowered. Some, but not all, of these problems are addressed in U.S. Pat. No. 3,835,380, where an electrometer probe is intermittently connected to a capacitor which stores a voltage level which is read by a meter even though the probe may be disconnected. The electrometer is eliminated in U.S. Pat. No. 3,892,481, where electrically floating sensing electrodes control the developer. A capacitor is intermittently connected to the electrodes and charged in accordance with their potentials.

SUMMARY OF THE INVENTION

This invention maintains copy quality by intermittently sensing, with a low current probe relatively insensitive to developer contamination, the photoconductor charge relative to a readily available reference without using additional modulating circuits and switches.

A metal plate is placed adjacent a photoconductor film placed over some, but not all, of a relatively conductive support. The entire plate, and that portion of the support in proximity to the plate, form a capacitor which is charged in accordance with the charge potential of the intervening material. As the support moves, different portions of the photoconductor pass between the capacitor plate and the support and, at intervals, the uncovered "seal" portion of the support passes therebetween. Thus, the probe capacitor charge will intermittently drop to zero as the seal passes and then for a period rise to a value determined by the charge on the photoconductor. During this period, another capacitor, in a high impedance sensing circuit, is charged to a potential determined in part by the probe capacitor's charge. The sensing circuit compares an externally controllable power supply's output to the probe capacitor's potential. A digital number, generated to represent the difference between the reference and the amount of photoconductor surface charge, adjusts the power supply until the difference is zero. The power supply output, or a variable controlled by the digital number corresponding to zero output from the sensing circuit, corrects selected copier process parameters affecting the photoconductor charge; for example, illumination, developer feed, coronas, etc.

The foregoing and other objects, features and advantages of the invention will be apparent from the following more particular description of preferred embodiments of the invention, as illustrated in the accompanying drawings.

DESCRIPTION OF THE PREFERRED EMBODIMENT

Figure 1:
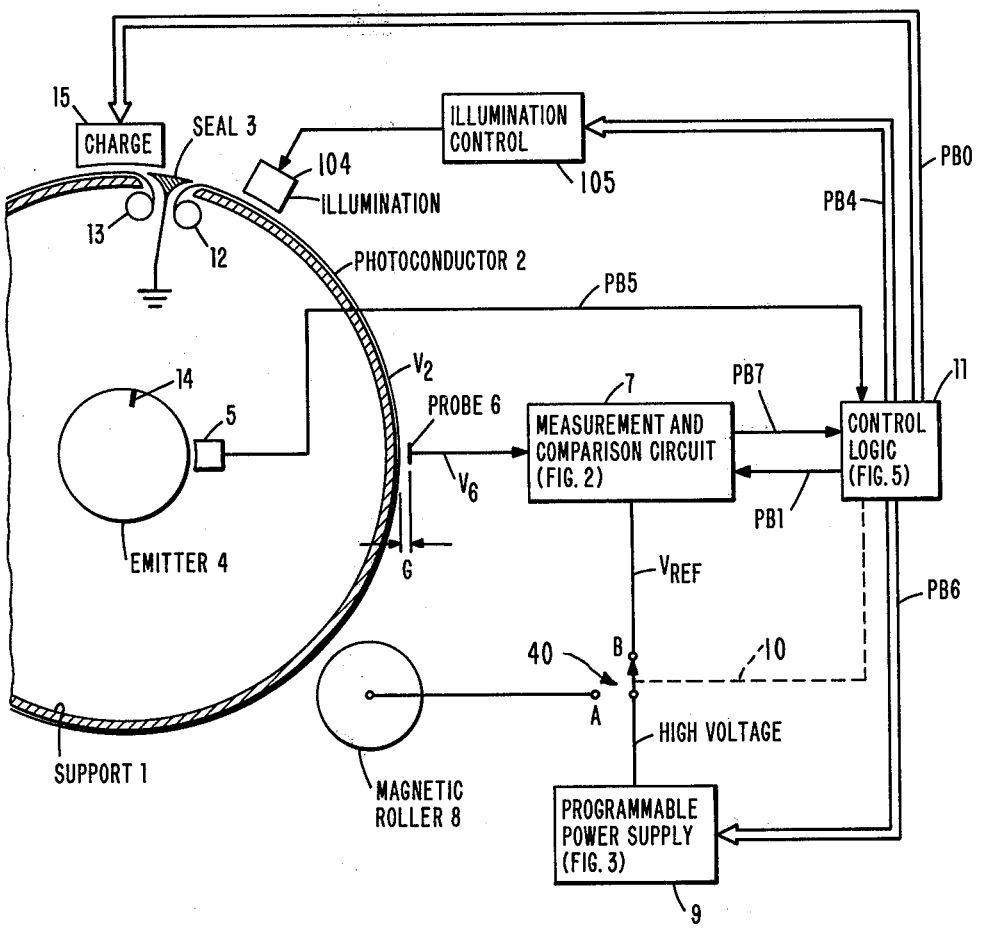
FIG. 1 is an overall view of the invention.

FIG. 1 illustrates the use of the invention to control the operation of a copier process. For purpose of illustration, a support 1 is shown carrying a photoconductor 2. The support 1 may take any form desired (for example a flat surface) and the photoconductor 2 need not be configured as shown (for example it may comprise a flat belt). In another variation, the support may carry a document coated with a chargeable surface functioning in place of the photoconductor. In the particular embodiment shown for illustration, the support 1 is circular so that the photoconductor 2 may be advanced to present a fresh surface by movement of reels 12 and 13. Since the point at which the photoconductor 2 enters the support 1 to contact the reels 12 and 13 cannot remain open to contaminants, one or more seals 3 are provided. In the embodiment shown, the support 1 is a conductive material as is the seal 3. The support 1 and the seal 3 are connected to a reference potential, for example ground. It is not essential that either or both the support 1 and seal 3 be connected to ground or to the same reference potential. The position of the seal 3 is externally indicated by an emitter wheel 4 carrying one or more indicia marks 14 which may be sensed by a sensor 5. Thus, in FIG. 1, a signal appears on the bus PB5 whenever the mark 14 indicates that the support 1 portion carrying the seal 3 is in a line with the sensor 5.

Toner or other developer may be applied to the photoconductor 2 surface by a magnetic roller 8 held at a potential by programmable power source 9 when a switch 40 is in position A. It will be understood that the switch 40 is only illustrative of a function which supplies a continuous (but adjustable) potential to magnetic roller 8 when in position A, while independently providing an adjustable potential to another circuit such as a measurement and comparison circuit 7 when in position B. The switch 40 may be placed in either position A or position B by a control line 10 connected to control logic 11. The function of switch 40 can be performed by, for example, two separate power supplies, one power supply with two separately adjustable outputs, etc. As is well known in the art, if the magnetic roller 8 rotates, a "magnetic brush" of developer particles will form and wipe across the photoconductor 2 surface. It is not essential to this invention that this particular technique be employed; however, it is desirable, for the purpose of the invention, that the amount of developer applied to the photoconductor 2 surface be determinable by a conveniently changeable variable such as a voltage from power supply 9. Also in the vicinity of the support 1 is provided a charge control device 15 capable of charging the photoconductor 2 to a desired potential for purposes of development, cleaning or other copier process functions. The only requirement of the invention is that there be some convenient technique of controlling the copier process by changing variables. The charge device 15, which can for example be a corona, provides a convenient example of this sort of device, as does the magnetic roller 8. Similarly, there is shown an illumination device 104 which may be used to provide initial copier illumination or which may be utilized for a variety of non-copy (such as discharge) purposes. An illumination control 105 is illustrative of a general technique of controlling illumination device 104. Each of the devices 8, 104 and 15 may be controlled by signals on corresponding buses PB6, PB4 and PB0.

Control logic 11 interconnects the signals from the sensor 5, the switch 40 and input/output ports via line 10 and control buses PB0, PB1, PB4, PB5, PB6 and PB7. When the mark 14 is lined up with the sensor 5, a signal on bus PB5 enables the control logic 11 to provide selected data signals to the programmable power supply 9 and to desired ones of the illumination control 105 and charge device 15 to make a desired adjustment at that time. The amount of adjustment required depends upon the charge detected on the photoconductor 2 in accordance with principles well known in the art of electrophotography.

The adjustment depends upon detection of the charge on the photoconductor 2 in an accurate and consistent manner. Probe 6, spaced a distance G from the surface of the photoconductor 2, forms one plate of a capacitor connected to measurement and comparison circuit 7. The other plate of the capacitor is formed by adjacent conductive material, whether it be the support 1 or the seal 3. In the example shown, as the support 1 passes beneath the probe 6, a potential charge is stored in the capacitor formed by the support 1 and the probe 6 as a function of the area of the probe, its spacing G and the material therebetween. The potntial E between a capacitor's plates is given in Sears and Zemansky, "College Physics, Part 2", page 452 (Addison-Wesley 1948) as:

$$E=(1/K\epsilon_0)\,(qd/A)$$

where K is the dielectric coefficient of material between the plates, d is their spacing, A their area, q the charge in either plate and $\epsilon_0$ the permitivity of empty space. In the case shown in the figure, for a given spacing G, the photoconductor 2, dielectric constant and charge determine the potential at the probe 6. Inasmuch as the dielectric constant will remain the same, (for a given environment, transient or permanent), the probe 6 will assume a potential $V_6$ determined by the photoconductor 2 charge potential $V_2$.

As the seal 3 passes under the probe 6, a reference, independent of the photoconductor 2 charge, is sensed by the probe 6. Assuming that the seal 3 is at a known potential (preferably ground), the desired variable that will thereafter affect the potential across the probe 6 is the actual charge on the photoconductor 2. If a seal 3 is not provided, some other reference may be provided; for example, a discrete area on the photoconductor 2 may be radically discharged. The charge across the probe 6 will not be significantly affected, during sequential cycles of operation, by small movements of the probe 6 or by contaminants. The measurement and comparison circuit 7 thus may accurately indicate to the control logic 11, on bus PB7, corrections necessary to bring the copier process within desired limits. The control logic 11 signals the measurement and comparison circuit 7, on bus PB1, when a series of sensing operations may begin.

To illustrate operation of the invention, assume that the measurement and comparison circuit 7 senses that the probe 6 potential $V_6$ has decreased relative a reference voltage $V_{Ref}$ (because the illumination value has changed, that potential available to the charge device 15 has changed, etc.). Then the measurement and comparison circuit indicate on bus PB7 an error signal will, when signaled by the control logic 11 on bus PB1. With switch 40 in position B, the control logic 11 then adjusts the programmable power supply 9 to supply different voltages $V_{Ref}$ to the measurement and comparison circuit 7 until the error signal approaches zero. The voltage $V_{Ref}$ may be used, directly (for example by changing switch 40 to position A) or indirectly (for example the illumination control 5 or charge device 15 may be adjusted until the measurement and comparison circuit 7 indicates, during the subsequent measurement, that the probe 6 potential $V_6$ has returned to a predetermined desired level potential relative to $V_{Ref}$).

Figure 2:
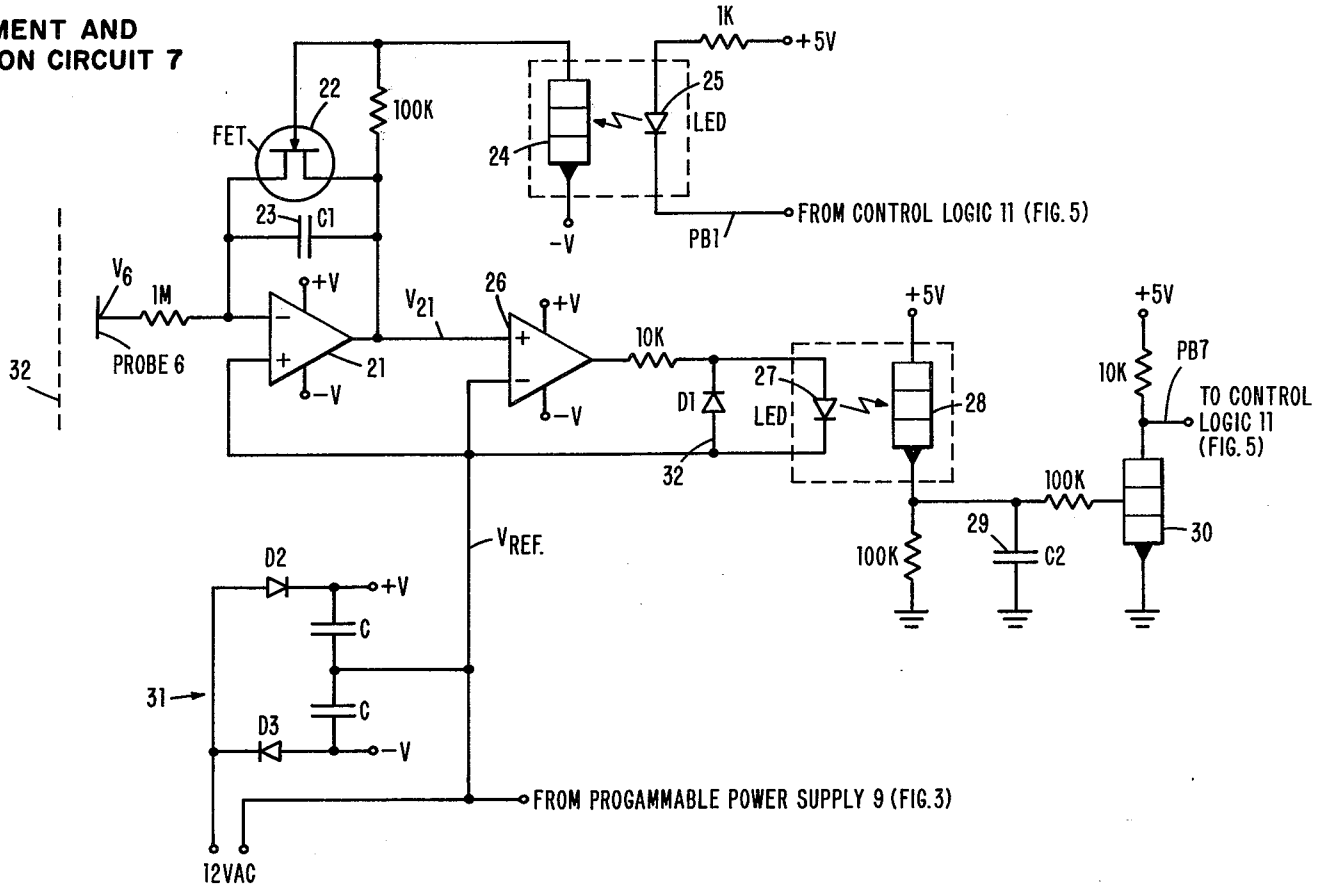
FIG. 2 is a circuit diagram of a measurement and comparison circuit.

Referring now to FIG. 2, the measurement and comparison circuit 7 will be described. The probe 6 forms one plate of a capacitor. The second plate, shown as 32, depends upon the relative positions of the support 1 and seal 3 and the charge on the photoconductor 2. In accordance with the relationship given in the Sears and Zemansky reference above, the potential $V_6$ (proportional to the difference between $V_{Ref}$ and $V_2$) across this capacitor is applied to an amplifier (operational amplifier 21) which charges a capacitor C1 23 to a value determined by the charge on the probe 6. The capacitor 23 is initially discharged by conduction across field effect transistor FET 22 when the control logic 11, via bus PB1, operates the light emitting diode 25 to cause the transistor 24 to become conductive. The potential $V_{21}$ across the capacitor 23 is applied by a comparator (operational amplifier 26) through an isolation circuit formed by light emitting diode 27, transistor 28 and noise-reduction capacitor 29 to an output bus PB7. Transistor 30 provides drive current to control logic circuit 11. Diode D1 32 acts as a signal voltage limiter. Reference voltage, $V_{Ref}$, indicative of the desired level of operation of the copier process, is supplied by the programmable power supply 9. Circuit 31 supplies operating potentials +V and −V to the components of measurement and comparison circuit 7.

Figure 3:
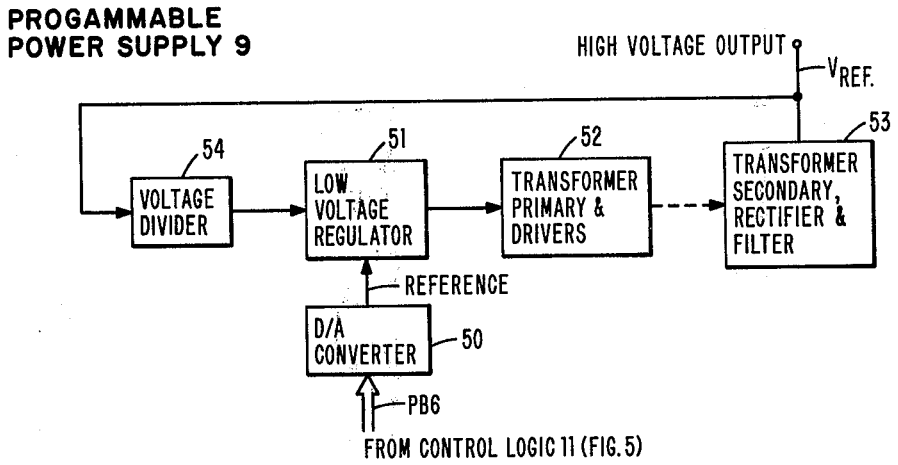
FIG. 3 is a block diagram of a programmable power supply.

The probe 6 potential to ground will depend upon the reference voltage $V_{Ref}$ from the programmable power supply 9. The potential $V_2$ on surface 32 will, therefore, determine the potential $V_6$ across the probe 6 capacitor and, therefore, the potential across the capacitor 23 and the voltage $V_{21}$ at the output of amplifier 21. The programmable power supply 9 voltage $V_{Ref}$ may be on the order of several hundred volts; whereas, the amplifier 21 output $V_{21}$ may be only a few volts. The high voltage $V_{Ref}$ is adjusted to approach the potential $V_6$ across the probe 6 by monitoring the low voltage $V_{21}$ as it approaches zero. Whenever the voltages $V_6$ and $V_{Ref}$ are equal, or if $V_{Ref}$ is greater than $V_6$, there will be a negative $V_{21}$ and pulse PB7 (signaling a request for a downward adjustment of $V_{Ref}$). If $V_{Ref}$ is less than $V_6$, there will be a positive $V_{21}$ and pulse PB7, which requests the power supply 9 to increase $V_{Ref}$. Three-level logic (no output on bus PB7 if $V_6=V_{Ref}$) may alternatively be implemented. The programmable power supply 9 utilized in the invention is illustrated in FIG. 3. This is a conventional high voltage circuit controlled by digital signals indicating the desired output voltage. The desired potential is indicated at input PB6 from control logic 11 to a digital-to-analog converter 50 which converts the digital data representations to an analog reference voltage supplied to a low voltage regulator 51. Transformer 52 and 53 supply a high voltage output as a function of the voltage supplied by the low voltage regulator. The regulator 51, transformer 52 and 53 and a voltage divider 54 together form a closed-loop oscillating system, in one type of programmable power supply, where the peak potential of the oscillating waveform is determined by the low voltage regulator 51. Thus, the envelope of the waveform may be used to provide, after rectification and filtering, a high voltage DC output $V_{Ref}$ which may be varied by changing the size of the envelope under external control. The illustrative control 11 and 50 changes the output voltage $V_{Ref}$ as a function of the binary value of an 8-bit data word on PB6. For example, binary value 1111—1111 (FF Hex) equals maximum negative $V_{Ref}$ and 0000—0000 (00 Hex) equals minimum negative $V_{Ref}$.

DESCRIPTION OF THE OPERATION OF THE PREFERRED EMBODIMENT

Figure 4:
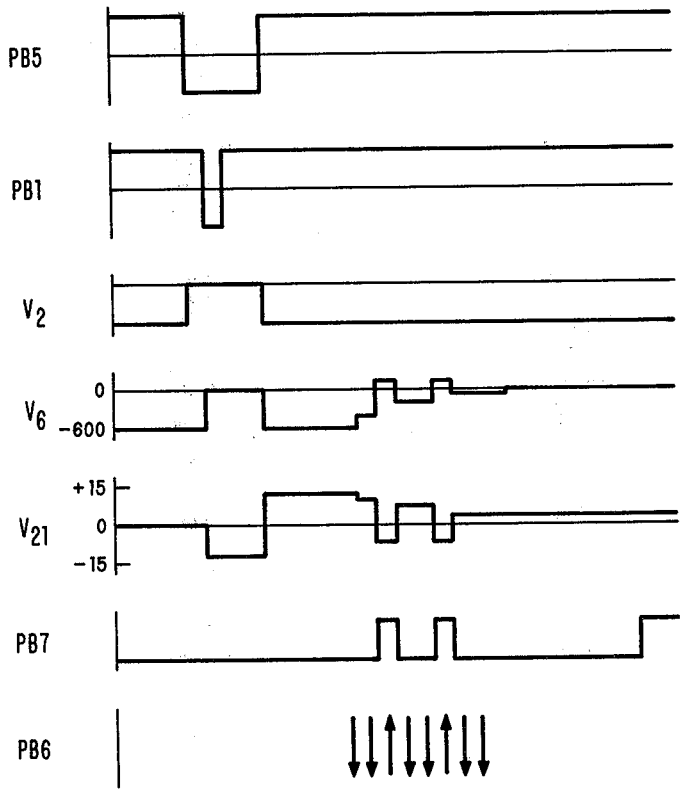
FIG. 4 is a waveform diagram illustrating signals occurring in the invention.

The operation of the invention will be described with reference to the waveforms of FIG. 4 which illustrate the operation of the circuits in FIGS. 2 and 3 with respect to the control logic of FIGS. 5A, 5B, 6A and 6B. Referring first to FIG. 4, the waveform diagram illustrates the interaction of the surface 1 position (along a path at a right angle to the distance G) relative to the probe 6 and the charge on the photoconductor 2. As the surface position relative to the probe 6 changes, in this manner, the seal ($V_2=0$) will be adjacent the probe 6 periodically, and the photoconductor 2 ($V_2=-400$, relative to ground, for example) will be adjacent at other times. The emitter mark 14 will correspond to the position of the sensor 5 whenever the seal position is adjacent the probe 6. The occurrence of this is signaled on bus PB5 to the control logic 11, which in turn initializes the measurement and comparison circuits 7 by a signal on bus PB1. Therefore, the potential across the capacitor 23, the output $V_{21}$ from the operational amplifier 21 and the output on PB7 to the control logic circuit 11 will be zero. As soon as the seal position passes out from under the probe 6, the probe 6 is affected by the photoconductor potential $V_2$. Thus, the potential $V_6$ across the probe 6 falls (for a negative $V_2$) and the potential across the capacitor 23 begins to rise rapidly toward a steady state value. The operational amplifier 21 output $V_{21}$ follows the voltages across the probe 6 and the capacitor 23. Selected positive signals on bus PB7 will occur, indicating how the programmable power supply 9 output voltage $V_{Ref}$ differs from the voltage $V_6$ across the probe 6. These signals on PB7 are translated to binary power supply correction data on PB6 by control logic 11. The following Table I shows the effect of power supply 9 positive (upward arrow) and negative (downward arrow) signals from bus PB6.

TABLE I

| PB6 | PB6 Binary | PB6 Hex | High Voltage ($V_{Ref}$) 9 |
|---|---|---|---|
| | 1111 1111 | FF | −600 |
| ↓ | 1000 0000 | 80 | −400 |
| ↓ | 0100 0000 | 40 | −200 |
| ↑ | 0110 0000 | 60 | −300 |
| ↓ | 0101 0000 | 50 | −250 |
| ↓ | 0100 1000 | 48 | −225 |
| ↑ | 0100 1100 | 4C | −238 |
| ↓ | 0100 1010 | 4A | −232 |
| ↓ | 0100 1001 | 49 | −235 |

Figure 5A:
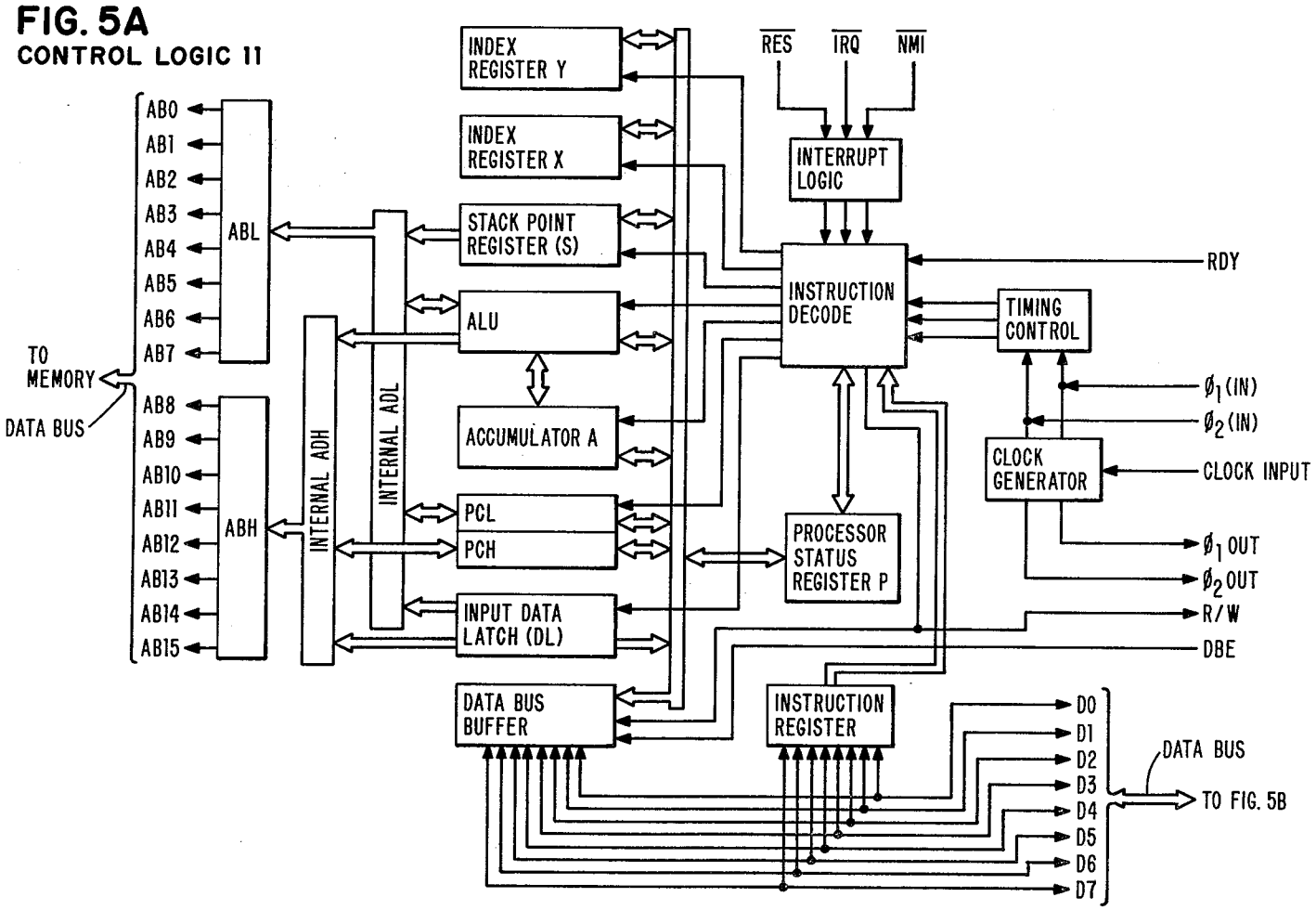
FIGS. 5A and 5B are block diagrams of control logic.
Figure 5B:
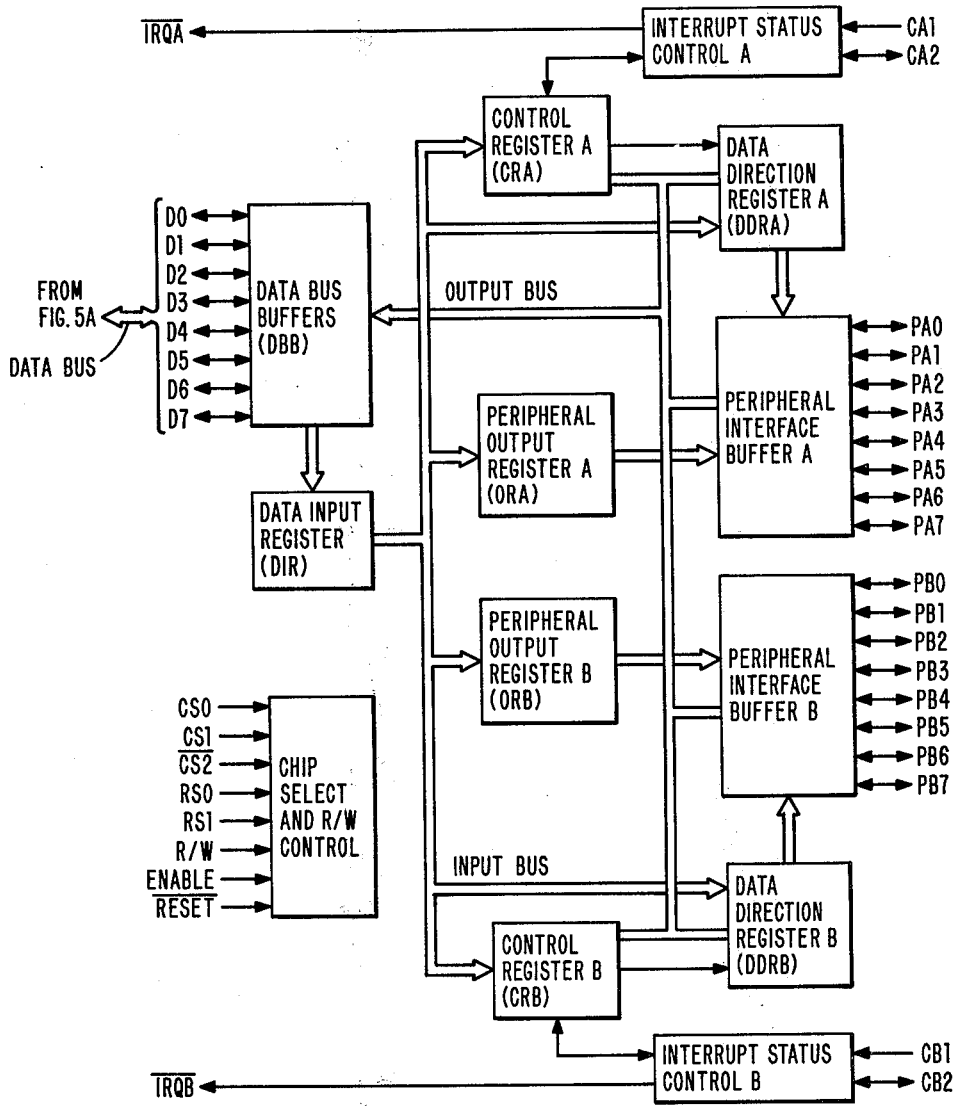

The control logic 11 receives the bus PB7 pulses and converts them into 8-bit digital data representations on bus PB6 which are used to control the programmable power supply 9. Ultimately, $V_{Ref}$ substantially equals $V_6$ when $V_{21}$ approaches zero. Referring to FIGS. 5A and 5B, there are illustrated the logic blocks representing the organization of a conventional processor for performing these functions. The processor illustrated may be the MCS6500 Microprocessor manufactured by MOS Technology, Incorporated and used in the Rockwell AIM 65 Microcomputer.

Figure 6A:
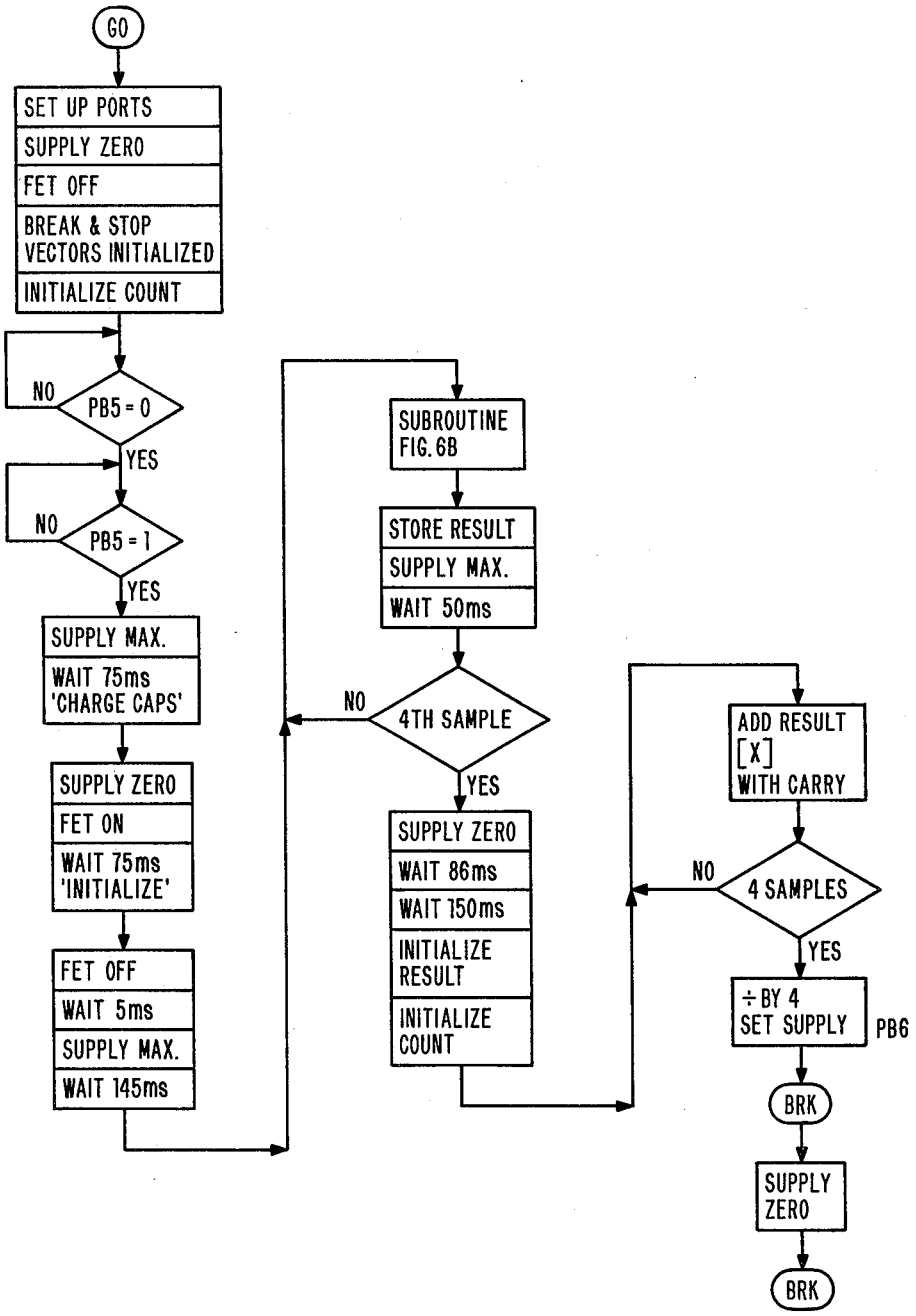
FIGS. 6A and 6B are flow diagrams illustrating operation of the invention.
Figure 6B:
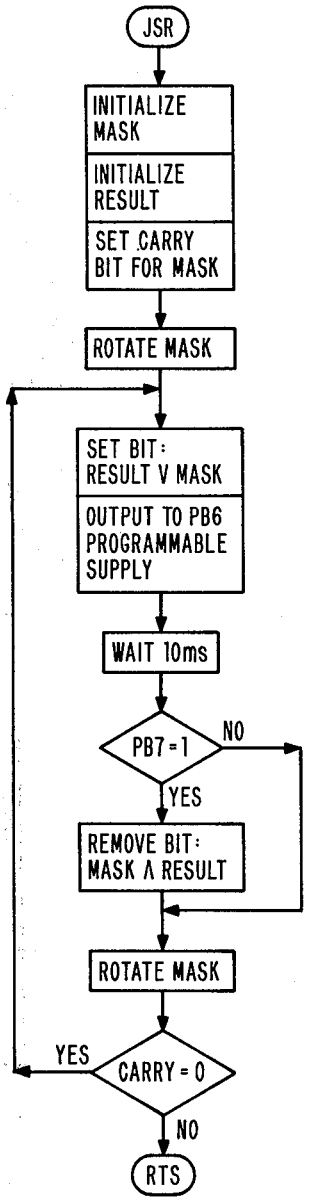

The microcomputer may be programmed using conventional assembly language source code as shown in FIGS. 6A and 6B and the incorporated listing of Table II, or, if desired, may be directly programmed in machine language or, alternatively, in a higher level language such as BASIC. It is not necessary to use the particular processor shown; any similar system or logic implementation will be equally useful with the invention. One particularly useful technique for bringing the programming power supply 9 output $V_{Ref}$ to equal the probe potential $V_6$ involves successive approximations and adjustments of $V_{Ref}$. As shown in Table I, given an 8-bit binary number from bus PB6, it is possible to approach $V_{21}=0$ ($V_{Ref}=V_6$) in eight steps. The basic operation involved starts with the highest binary number (FF Hexadecimal), equivalent to $V_{Ref}=-600$ volts. If this is too high ($V_{21}=\downarrow$), then the highest order bit is set to "1", giving a binary number (80 Hex) equivalent to $V_{Ref}=-400$. If this is too high, the highest order bit is reset to "0" and the next lowest order bit is set to "1" to give a binary number (40 Hex) equivalent to $-200$ volts. On the other hand, if the previous voltage $V_{Ref}=-400$ had been too low, then the highest order bit would have remained set to "1", while the next lowest order bit was set to "1", giving a binary number (CO Hex) equivalent to $-500$ volts. In this way, the desired value of $V_{Ref}$ is always approached in eight steps. If desired, larger voltage changes can be used permitting 4-bit characters and requiring only four steps.

Referring to FIG 5A, there are provided eight lines DO–D7 connecting a main processor section via a data bus to a main input/output section in FIG. 5B. A memory, not shown, is connected to an address bus (lines A0–A17) as well as to the data bus. A program of instructions is stored in the memory and is decoded by an instruction decode apparatus. The instructions result in the manipulation of data among the registers, shown, and the performance of arithmetic operations in the arithmetic logic unit ALU. Referring to FIG. 5B, there are shown two peripheral interface buffers A and B. Each of the buffers has eight input/output ports numbered from, for example, PB0–PB7. The ports attached to the peripheral interface buffer B correspond to the buses indicated as PB0, PB1–PB4, PB5, PB6 and PB7 in FIG. 1. Information available on ports to peripheral interface buffer B is transferred via the data bus to FIG. 5 and, ultimately, to the memory. Similarly, data from the memory is transferred over the same route outward to the ports.

In operation, referring to Table I, FIG. 4 and FIG. 6A and the listing of Table II, the ports are examined for data to determine whether operations are required, data is received from the ports, data manipulations are performed and data is sent out of the ports. With switch 40 in position A, the position of the mark 14 as sensed by the sensor 5 is indicated on port PB5. When a signal transition is sensed at port PB5, the field effect transistor 22 is turned on via port PB1 to initialize the circuit. The probe potential $V_6$ is then measured four times by the successive approximation technique described above.

Referring to FIG. 6B, 8-bit binary characters are sent, one after another, to port PB6, to which is connected the programmable power supply 9, as long as a signal at port PB7 connected to the measurement and comparison circuit 7 indicates that the power supply $V_{Ref}$ and probe voltages $V_6$ are not equal (PB7=1). This is accomplished by monitoring the condition of the signal at port PB7 and adjusting (by setting and removing bits) the digital data supplied to the programmable power supply 9 as a function thereof. After this operation is completed, the routine shown in FIG. 6A continues. Four samples are taken from the measurement and comparison circuit 7, and after the fourth repetition of the subroutine in FIG. 6B, the four samples are averaged. Once the probe 6 potential $V_6$ equals the power supply 9 voltage $V_{Ref}$, the photoconductor 2 charge will have been accurately determined. Control logic then compares this value against a predetermined desired value, adjusts either power supply 9 (with switch 40 in position B), or one of the illumination controls 5 (via PB4) or charge control 15 (via PB0) until the two values are equal. Successive adjustments of the power supply 9 and the selected charge controls 9, 105 and 15 will be necessary. In one alternative, a service alarm may be set if the measured photoconductor 2 charge differs from the predetermined value by a predetermined amount.

While the invention has been particularly shown and described with reference to preferred embodiments thereof, it will be understood by those skilled in the art that various changes in form and details may be made therein without departing from the spirit and scope of the invention.

TABLE II

| LOCN | CD | AND | | NO | LABEL | OP | T | Operand | Comment |
|---|---|---|---|---|---|---|---|---|---|
| | | | | 1 | CNTL11 | ORG | | H0200 | ESP CONTROL - ROBOT |
| 0200 | A9 | FF | | 2 | | LDA | I | HFF | SET PA PORTS TO OUTPUT |
| 0202 | 8D | 01 | 17 | 3 | | STA | A | H1701 | |
| 0205 | A9 | 00 | | 4 | | LDA | I | 0 | SUPPLY ZERO (PA0 – 7 = 0) |
| 0207 | 8D | 00 | 17 | 5 | | STA | A | H1700 | |
| 020A | A9 | 0F | | 6 | | LDA | I | HOF | SET PB7,5,4 INPUT |
| 020C | 8D | 03 | 17 | 7 | | STA | A | H1703 | SET PB3,2,1,0 OUTPUT |
| 020F | A9 | 00 | | 8 | | LDA | I | 0 | FET OFF (PB1 = 0) |
| 0211 | 8D | 02 | 17 | 9 | | STA | A | H1702 | |
| 0214 | A9 | 00 | | 10 | | LDA | I | 0 | BREAK AND STOP VECTORS |
| 0216 | 8D | FE | 17 | 11 | | STA | A | H17FE | STORED AT IRQ AND NMI |
| 0219 | 8D | FA | 17 | 12 | | STA | A | H17FA | -- RETURNS CONTROL TO |
| 021C | A9 | 1C | | 13 | | LDA | I | H1C | KIM MONITOR |
| 021E | 8D | FF | 17 | 14 | | STA | A | H17FF | |
| 0221 | 8D | FB | 17 | 15 | | STA | A | H17FB | |
| 0224 | A2 | 00 | | 16 | | LDX | I | 0 | INITIALIZE COUNT -- X |
| 0226 | AD | 02 | 17 | 17 | WAITO | LDA | A | H1702 | WAIT FOR PB5 = 0 |
| 0229 | 29 | 20 | | 18 | | AND | I | H20 | |
| 022B | D0 | F9 | | 19 | | →≠0 | | WAITO | |
| 022D | AD | 02 | 17 | 20 | WAIT1 | LDA | A | H1702 | WAIT FOR PB5 = 1 |
| 0230 | 29 | 20 | | 21 | | AND | I | H20 | |
| 0232 | F0 | F9 | | 22 | | →=0 | | WAIT1 | |
| 0234 | A9 | 01 | | 23 | | LDA | I | H01 | CHART RECORDER ON |
| 0236 | 8D | 02 | 17 | 24 | | STA | A | H1702 | (PBO = 1) |
| 0239 | A9 | FF | | 25 | | LDA | I | HFF | SUPPLY MAX (PA0 – 7 = 1) |
| 023B | 8D | 00 | 17 | 26 | | STA | A | H1700 | |
| 023E | A9 | 49 | | 27 | | LDA | I | H49 | START ÷ 1024 TIMER |
| 0240 | 8D | 07 | 17 | 28 | | STA | A | H1707 | |
| 0243 | 2C | 07 | 17 | 29 | T1 | BIT | A | H1707 | WAIT FOR TIMER 75 MS |
| 0246 | 10 | FB | | 30 | | →PL | | T1 | |
| 0248 | A9 | 00 | | 31 | | LDA | I | 0 | SUPPLY ZERO (PA0 – 7 = 0) |

TABLE II-continued

| LOCN | CD | AND | | NO | LABEL | OP | T | Operand | Comment |
|---|---|---|---|---|---|---|---|---|---|
| 024A | 8D | 00 | 17 | 32 | | STA | A | H1700 | |
| 024D | A9 | 03 | | 33 | | LDA | I | H03 | FET ON (PB1 = 1) |
| 024F | 8D | 02 | 17 | 34 | | STA | A | H1702 | |
| 0252 | A9 | 18 | | 35 | | LDA | I | H18 | START ÷ 1024 TIMER |
| 0254 | 8D | 07 | 17 | 36 | | STA | A | H1707 | |
| 0257 | 2C | 07 | 17 | 37 | T2 | BIT | A | H1707 | WAIT FOR TIMER 25 MS |
| 025A | 10 | FB | | 38 | | →PL | | T2 | |
| 025C | A9 | 01 | | 39 | | LDA | I | H01 | FET OFF (PB1 = 0) |
| 025E | 8D | 02 | 17 | 40 | | STA | A | H1702 | |
| 0261 | A9 | 4E | | 41 | | LDA | I | H4E | START ÷ 64 TIMER |
| 0263 | 8D | 06 | 17 | 42 | | STA | A | H1706 | |
| 0266 | 2C | 07 | 17 | 43 | T3 | BIT | A | H1707 | WAIT FOR TIMER 5 MS |
| 0269 | 10 | FB | | 44 | | →PL | | T3 | |
| 026B | A9 | FF | | 45 | | LDA | I | HFF | SUPPLY MAX (PA0 – 7 = 1) |
| 026D | 8D | 00 | 17 | 46 | | STA | A | H1700 | |
| 0270 | A9 | 8E | | 47 | | LDA | I | HBE | START ÷ 1024 TIMER |
| 0272 | 8D | 07 | 17 | 48 | | STA | A | H1707 | |
| 0275 | 2C | 07 | 17 | 49 | T4 | BIT | A | H1707 | WAIT FOR TIMER 145 MS |
| 0278 | 10 | FB | | 50 | | →PL | | T4 | |
| 027A | 20 | F4 | 02 | 51 | LOOPA | JSR | A | SAMPLE | SUCCESSIVE APPROXIMATE |
| 027D | E8 | | | 52 | | INX | | | STORE RESULT IN TABLE |
| 027E | A5 | 00 | | 53 | | LDA | 0 | RESULT | |
| 0280 | 95 | 00 | | 54 | | STA | Z | RESULT | |
| 0282 | A9 | FF | | 55 | | LDA | I | HFF | SUPPLY MAX (PA0 – 7 = 1) |
| 0284 | 8D | 00 | 17 | 56 | | STA | A | H1700 | |
| 0287 | A9 | 31 | | 57 | | LDA | I | H31 | START ÷ 1024 TIMER |
| 0289 | 8D | 07 | 17 | 58 | | STA | A | H1707 | |
| 028C | 2C | 07 | 17 | 59 | T5 | BIT | A | H1707 | WAIT FOR TIMER 50 MS |
| 028F | 10 | FB | | 60 | | →PL | | T5 | |
| 0291 | A9 | 05 | | 61 | | LDA | I | H05 | START INTEGRATION |
| 0293 | 8D | 02 | 17 | 62 | | STA | A | H1702 | |
| 0296 | E0 | 04 | | 63 | | CPX | I | H04 | CHECK FOR 4TH SAMPLE |
| 0298 | D0 | E0 | | 64 | | →≠0 | | LOOPA | |
| 029A | A9 | 00 | | 65 | | LDA | I | 0 | SUPPLY ZERO (PAC – 7 = 0) |
| 029C | 8D | 00 | 17 | 66 | | STA | A | H1700 | |
| 029F | A9 | 54 | | 67 | | LDA | I | H54 | START ÷ 1024 TIMER |
| 02A1 | 8D | 07 | 17 | 68 | | STA | A | H1707 | |
| 02A4 | 2C | 07 | 17 | 69 | T6 | BIT | A | H1707 | WAIT FOR TIMER 86 MS |
| 02A7 | 10 | FB | | 70 | | →PL | | T6 | |
| 02A9 | A9 | 01 | | 71 | | LDA | I | H01 | STOP INTEGRATION |
| 02AB | 8D | 02 | 17 | 72 | | STA | A | H1702 | |
| 02AE | A9 | 93 | | 73 | | LDA | I | H93 | START ÷ 1024 TIMER |
| 02B0 | 8D | 07 | 17 | 74 | | STA | A | H1707 | |
| 02B3 | 2C | 07 | 17 | 75 | T7 | BIT | A | H1707 | WAIT FOR TIMER 150 MS |
| 02B6 | 10 | FB | | 76 | | →PL | | T7 | |
| 02B8 | A9 | 00 | | 77 | | LDA | I | 0 | CHART RECORDER OFF |
| 02BA | 8D | 02 | 17 | 78 | | STA | A | H1702 | |
| 02BD | A9 | 00 | | 79 | | LDA | I | 0 | INITIALIZE RESULT |
| 02BF | 85 | 00 | | 80 | | STA | 0 | RESULT | |
| 02C1 | 85 | 0A | | 81 | | STA | 0 | RESULTHI | INITIALIZE RESULTHI |
| 02C3 | A2 | 00 | | 82 | | LDX | I | 0 | INITIALIZE COUNT – X |
| 02C5 | E8 | | | 83 | LOOPB | INX | | | INCREMENT COUNT |
| 02C6 | 18 | | | 84 | | CLC | | | CLEAR CARRY |
| 02C7 | A5 | 00 | | 85 | | LDA | 0 | RESULT | LOAD RESULT |
| 02C9 | 75 | 00 | | 86 | | ADC | Z | RESULT | ADD RESULT[X] |
| 02CB | 85 | 00 | | 87 | | STA | 0 | RESULT | STORE IN RESULT |
| 02CD | A5 | 0A | | 88 | | LDA | 0 | RESULTHI | LOAD HIGH ORDER RESULT |
| 02CF | 69 | 00 | | 89 | | ADC | I | 0 | ADD CARRY INTO HI RSLT |
| 02D1 | 85 | 0A | | 90 | | STA | 0 | RESULTHI | |
| 02D3 | E0 | 04 | | 91 | | CPX | I | H04 | CHECK FOR 4TH SAMPLE |
| 02D5 | D0 | EE | | 92 | | →≠0 | | LOOPB | |
| 02D7 | 46 | 0A | | 93 | | LSR | 0 | RESULTHI | SHIFT RESULTHI RIGHT |
| 02D9 | 66 | 00 | | 94 | | ROR | 0 | RESULT | SHIFT RESULT RIGHT |
| 02DB | 46 | 0A | | 95 | | LSR | 0 | RESULTHI | AGAIN |
| 02DD | 66 | 00 | | 96 | | ROR | 0 | RESULT | AGAIN |
| 02DF | A5 | 00 | | 97 | | LDA | 0 | RESULT | LOAD RESULT |
| 02E1 | 69 | 00 | | 98 | | ADC | I | 0 | ADD CARRY TO ROUND |
| 02E3 | 85 | 00 | | 99 | | STA | 0 | RESULT | STORE FINAL RESULT |
| 02E5 | 8D | 00 | 17 | 100 | | STA | A | H1700 | SET PROG SUPPLY |
| 02E8 | 00 | | | 101 | | BRK | | | STOP EXECUTION |
| 02E9 | EA | | | 102 | | NOP | | | |
| 02EA | A9 | 00 | | 103 | | LDA | I | 0 | SUPPLY ZERO (PA0 – 7 = 0) |
| 02EC | 8D | 00 | 17 | 104 | | STA | A | H1700 | |
| 02EF | 00 | | | 105 | | BRK | | | STOP EXECUTION |
| 02FO | EA | | | 106 | | NOP | | | |
| 02F1 | 4C | 00 | 02 | 107 | | JMP | A | CNTL11 | RESTART PROGRAM |
| 02F4 | A9 | 00 | | 108 | SAMPLE | LDA | I | 0 | INITIALIZE MASK, RESULT |
| 02F6 | 85 | 09 | | 109 | | STA | 0 | MASK | |
| 02F8 | 85 | 00 | | 110 | | STA | 0 | RESULT | |
| 02FA | 38 | | | 111 | | SEC | | | SET CARRY FOR MASK BIT |
| 02FB | 66 | 09 | | 112 | | ROR | 0 | MASK | ROTATE MASK |

TABLE II-continued

| LOCN | CD | AND | | NO | LABEL | OP | T | Operand | Comment |
|---|---|---|---|---|---|---|---|---|---|
| 02FD | A5 | 00 | | 113 | REPEAT | LDA | 0 | RESULT | SET BIT; |
| 02FF | 05 | 09 | | 114 | | ORA | 0 | MASK | RESULT MASK |
| 0301 | 85 | 00 | | 115 | | STA | 0 | RESULT | STORE RESULT |
| 0303 | 8D | 00 | 17 | 116 | | STA | A | H1700 | OUTPUT TO PROG SUPPLY |
| 0306 | A9 | AB | | 117 | | LDA | I | HA8 | START ÷ 64 TIMER |
| 0308 | 8D | 06 | 17 | 118 | | STA | A | H1706 | |
| 030B | 2C | 07 | 17 | 119 | T9 | BIT | A | H1707 | WAIT FOR TIMER 11 MS |
| 030E | 10 | FB | | 120 | | →PL | | T9 | |
| 0310 | 2C | 02 | 17 | 121 | | BIT | A | H1702 | TEST PB7 |
| 0313 | 10 | 08 | | 122 | | →PL | | ROTATE | BRANCH IF PB7 = 0 |
| 0315 | A5 | 09 | | 123 | | LDA | 0 | MASK | REMOVE BIT; |
| 0317 | 49 | FF | | 124 | | EOR | I | HFF | (~MASK) RESULT |
| 0319 | 25 | 00 | | 125 | | AND | 0 | RESULT | |
| 031B | 85 | 00 | | 126 | | STA | 0 | RESULT | |
| 031D | 66 | 09 | | 127 | ROTATE | ROR | 0 | MASK | ROTATE MASK |
| 031F | 90 | DC | | 128 | | →CC | | REPEAT | REPEAT IF CARRY = 0 |
| 0321 | 60 | | | 129 | | RTS | | | |
| | | | | 130 | | END | | | |

What is claimed is:

1. Apparatus for measuring an unknown electrical charge on a photoconductor, including:

a moving surface carrying a conductor having a known reference charge and a photoconductor having an unknown charge, forming one plate of a capacitor;

a probe, spaced from said surface, forming a second plate of said capacitor, for sensing as a potential the charge on the photoconductor and conductor as a function of its distance therefrom;

a measurement circuit, having an input connected to the capacitor, an output for supplying sequences of pulses indicative of the potential of the conductor and the photoconductor relative to the conductor as the surface passes the probe, and a control input operable to identify the conductor passing the probe;

adjustable potential means, having an output associated with the probe operable in accordance with signals at an input to vary its output level; and logic means, interconnecting the measurement circuit and potential means, for supplying adjustment signals to the potential means input as a function of sequences of pulses from the measurement circuit which vary the potential of the probe relative to the conductor until the voltage across the capacitor plates substantially equals a reference value.

2. The apparatus of claim 1, wherein there are provided charge control means connected between the logic means and the moving surface operable in accordance with the adjustment signals to change the photoconductor charge.

3. The apparatus of claim 2, wherein the measurement circuit includes a switched operational amplifier connected to the capacitor and to the control input, operable to supply a range of output voltages proportional to, but substantially less than, the potentials as the photoconductor passes the probe, and operable to supply a single output voltage when the control input identifies a conductor passing the probe.

4. A method for measuring an unknown electrical charge on a photoconductor, including the steps of:

moving a surface carrying a conductor having a known reference charge and a photoconductor having an unknown charge;

sensing as a potential on a probe the charge on the photoconductor and conductor as a function of its distance therefrom;

supplying a sequence of measurement pulses indicative of the potential of the conductor and the photoconductor relative to the conductor as the surface passes the probe;

identifying the conductor passing the probe; and varying the potential of the probe relative to the conductor as a function of seqences of measurement pulses until the voltage between the conductor and probe substantially equals a reference value.

5. The method of claim 4 including the step of changing the photoconductor charge as a function of the measurement pulses.

* * * * *